United States Patent [19]

Hatanaka et al.

[11] Patent Number: 4,549,071

[45] **Date of Patent: * Oct. 22, 1985**

[54] GLOW PLUG FOR USE IN DIESEL ENGINE

[75] Inventors: Koji Hatanaka; Tozo Takizawa, both of Higashimatsuyama, Japan

[73] Assignee: Jidosha Kiki Co., Ltd., Tokyo, Japan

[ * ] Notice: The portion of the term of this patent subsequent to Oct. 9, 2001 has been disclaimed.

[21] Appl. No.: 535,301

[22] Filed: Sep. 23, 1983

Related U.S. Application Data

[63] Continuation-in-part of Ser. No. 372,311, Apr. 27, 1982, Pat. No. 4,476,378.

[30] Foreign Application Priority Data

Sep. 28, 1982 [JP] Japan ..... 57-168738

[51] Int. Cl.[4] ..... F23Q 7/22

[52] U.S. Cl. ..... 219/270; 123/145 A; 219/523; 219/553; 361/266; 338/22 R; 338/299

[58] Field of Search ..... 219/260, 267, 270, 523, 219/552, 553; 361/264, 265, 266; 123/145 R, 145 A; 431/208; 338/22 R, 218, 299, 303

[56] References Cited

U.S. PATENT DOCUMENTS

| | | | |
|---|---|---|---|
| 4,211,204 | 7/1980 | Glauner et al. | 123/145 A |
| 4,423,309 | 12/1983 | Murphy et al. | 219/270 |

FOREIGN PATENT DOCUMENTS

| | | | |
|---|---|---|---|
| 586327 | 7/1981 | Japan | 219/270 |
| 57-26326 | 2/1982 | Japan | 219/270 |
| 254482 | 7/1926 | United Kingdom | 219/270 |
| 1215013 | 12/1970 | United Kingdom | 219/270 |
| 2013277 | 8/1979 | United Kingdom | 219/270 |

*Primary Examiner*—Volodymyr Y. Mayewsky
*Attorney, Agent, or Firm*—Charles E. Pfund

[57] ABSTRACT

In a glow plug for use in a diesel engine of the type comprising a first helical heating member, a second helical heating member connected to the first heating member and made of material having larger positive resistance temperature coefficient than that of the first heating member, and a sheath enclosing the first and second heating members, the ratio between the length of the first heating member and the sheath diameter is selected to be less than 1.5, and the resistance ratio at normal temperature of the first and second heating members is selected to lie in a range of from 2.5 to 7.0.

1 Claim, 14 Drawing Figures

GLOW PLUG FOR USE IN DIESEL ENGINE

This application is a continuation-in-part of applicants' copending application Ser. No. 372,311, filed Apr. 27, 1982, now U.S. Pat. No. 4,476,378.

BACKGROUND OF THE INVENTION

This invention relates to a glow plug utilized to preheat the sub- or auxiliary combustion chamber or the main combustion chamber of a diesel engine.

The starting characteristic of a diesel engine is generally poor at low temperature so that it is the common practice to increase the suction temperature by installing a glow plug in the sub-combustion chamber or main combustion chamber and by passing electric current through the glow plug. The glow plug is also used as a source of ignition for improving the starting characteristic of the diesel engine. As the glow plug, the so-called sheathed type glow plug has been used in which a helical heating wire made of iron, chromium or nickel or alloys thereof is packed in a heat resistant electric insulating powder contained in a sheath made of heat resistant metal. The sheathed type glow plug can be used over a long time in high temperature gas in the sub- or main combustion chamber.

With the sheathed type glow plug described above, since the sheath is heated indirectly by the heating wire it takes a long time to increase the temperature of the glow plug to the operating temperature. More particularly, the heat generated by passing electric current through the heating wire is transmitted to the sheath through the heat resistant electric insulating powder, it takes a long time before the sheath becomes red hot. Moreover, the efficiency of heat transmission is low. Thus for example, it takes several of tens seconds until the temperature of the plug is increased to 900° C., for example necessary to start the engine, thus failing to rapidly start the diesel engine.

The temperature rise time can be decreased by supplying a large electric power at the initial stage of energization so as to cause the heating wire to quickly generate heat, but such measure is liable to melt the heating wire or to damage the sheath by high temperature. This also affects the battery and electric circuit and in an extreme case melts a fuse. To prevent these problems, it is necessary to provide a temperature control device for the heating wire which increases the cost of the preheating device.

In recent years, diesel engines are abundantly used for general purpose motor cars, and in order to make the diesel engines to be comparable with gasoline engines it is desired to develop a quick heating type glow plug for improving the starting characteristic.

To meet such requirement, various improvements have been made including the selection of the material for the heating wire, and to improve the temperature rise characteristic by supplying a large electric power. Glow plugs have been developed in which heating wires made of two types of materials having different resistance temperature coefficients are used as disclosed in British Patent No. 1,376,817 and Japanese Laid Open Patent Specification No. 109,538 of 1979.

Although the glow plug utilizing heating wires made of two types of materials can quickly raise the temperature, its cost of manufacturing is high and the heat generating characteristic is not yet satisfactory, so that there are many points to be improved.

We have made exhaustive researches and investigations for more efficiently utilizing the advantage of using a heating wire made of two types of materials and found that in order to obtain a glow plug having an optimum characteristic, it is necessary to set the length of two heating wires especially the front heating wire and the resistance ratio of two heating wires in predetermined ranges.

There are many factors that contribute to the improvement of the heating characteristics of the glow plug of the type described above. Among these factors may be mentioned the materials of the two types of the heating members, diameter of the wire, outer diameters of the heating members, the length thereof, resistance value at room temperature (20° C.); and the material, wall thickness, outer diameter and length of the sheath, as well as the voltage applied to the glow plug. It is difficult to determine which one of these many factors constitutes the basic factor that determines unique characteristic of the glow plug.

In order to obtain a satisfactory heating characteristic of the glow plug it is necessary to select various factors described above by taking into consideration the time necessary to reach 900° C. necessary to start the diesel engine, that is rapid heating characteristic, and limiting the saturation temperature to about 1000° C.–1100° C. thereby ensuring the durability of the heating members.

Furthermore, we have found that in the prior art glow plug, since two types of the heating members are disposed too closely, the rear heating member acting as the heating element is influenced by the heat generated by the front (first) heating member acting as an heating element so that the resistance value of the rear (second) heating member increases rapidly, thus shortening the supply time of large power to the front heating member at the initial stage of current supply.

More particularly, in the prior art glow plug of this type, a heating member having a lower resistance temperature coefficient is disposed on the front side, while a heating member having a higher resistance temperature coefficient is disposed on the rear side and wherein the resistance variation caused by the temperature variation of the rear side heater is used to supply large power to the front side heating member immediately after starting energization so as to rapidly red heat the front side heating member. However, since both heating members are too closely disposed the temperature of the rear side heating member is quickly raised in a short time due to the effect of heat from the front side heating member whereby the electric power supplied to the front side heating member is limited. For this reason the prior art glow plug of this type can not manifest rapid heating characteristic.

SUMMARY OF THE INVENTION

Accordingly, it is an object of this invention to provide an improved glow plug including serially connected front and rear heating members and capable of concentrating electric power to the front heating member so as to rapidly heat it to red heat state thereby improving the temperature build-up characteristic of the plug.

Another object of this invention is to provide an improved glow plug of the type just mentioned wherein the overheating of the front heating member can be prevented by controlling the current flowing through the front heating member by utilizing its control performance, thus providing stable and rapid heating type optimum heat generating characteristic.

Still another object of this invention is to provide a glow plug for use in a diesel engine capable of delaying heat transmission from the front heating member to the rear heating member thus further improving the heat generating characteristic.

According to this invention, these and further objects can be accomplished by providing a glow plug for use in a diesel engine comprising a first helical heating member, a second helical heating member electrically connected to one end of the first heating member and made of an electroconductive material having larger positive resistance temperature coefficient than that of the first heating member, and a sheath covering the first and second heating members, wherein the ratio between the length of the firt heating member and the sheath diameter is selected to be less than 1.5 and the resistance ratio at normal temperature of the first and second heating members is selected in a range of from 2.5 to 7.0.

The second heating member is made of low carbon steel containing less than 0.25% by weight of carbon. The first and second heating members are separated by a gap having a length of about 1.5 to 12 times of the winding pitch of the first heating member.

BRIEF DESCRIPTION OF THE DRAWINGS

In the accompanying drawings

DESCRIPTION OF THE PREFERRED EMBODIMENTS

Figure 1:
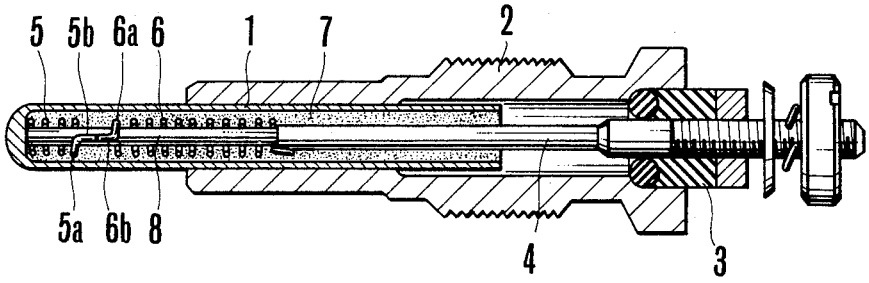
FIG. 1 is a longitudinal sectional view showing the construction of one embodiment of a glow plug according to this invention and utilized in a diesel engine.
Figure 2:
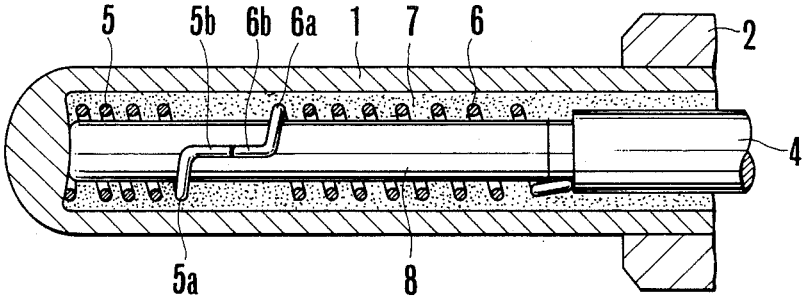
FIG. 2 is an enlarged longitudinal sectional view of the front portion of the glow plug shown in FIG. 1.

A glow plug embodying the invention and shown in FIGS. 1 and 2 comprises a sheath 1 made of such heat resistant metal as stainless steel or the like, a housing 2 which holds the sheath 1 at its tip, and an electrode rod 4 concentrically secured to the rear end of the housing 2 via an insulating bushing 3, the tip of the electrode rod 4 extending into the sheath 1.

A first helical heater 5 made of a electroconductive material having a small resistance temperature coefficient of about $5\times10^{-5}$/°C., for example an ferrochromium alloy or a nickel-chromium alloy is disposed to extend in the axial direction in a space within the front end of the sheath 1 and one end of a helical first heater that is a heating member 5 is electrically connected to the tip of the sheath 1.

In a space within the rear side of the sheath 1 and between the rear end of the first heater 5 and the electrode rod 4 at the rear end of the sheath 1 is disposed a second helical heater or heating member 6 made of electric conductive material having a larger resistance temperature coefficient of about $5\times10^{-3}$/°C. and made of nickel or low carbon steel containing less than 0.25% by weight of carbon, the first and second heaters extending coaxially. These first and second heaters 5 and 6 are embedded in a heat resistance electric insulating powder 7 such as magnesia packed in the sheath 1.

The second heater 6 is made of such electroconductive materials having high resistance temperature coefficients as platinum (about $4\times10^{-3}$/°C.), tungsten (about $5\times10^{-3}$/°C.) and molybdenum (about $4\times10^{-3}$/°C.).

The second heater 6 acts not only as a heat source but also as a temperature control means which supplies a large power immediately after passing the current but decreases the power with time thus limiting the saturation temperature of the glow plug and hence preventing over-heating of the glow plug. Thus, the second heater 6 is made of material having larger resistance temperature coefficient than that comprising the first heater 5 so that immediately after passing the current the quantity of heat generated by the second heater 6 is extremely small and hence its resistance is also low. As the time of current flow elapses the temperature of the second heater 6 increases gradually due to the heat generated by itself and the heat conducted from the first heater 5 and the resistance of the second heater 6 increases in proportion to its temperature rise, thus limiting the power supplied to the first heaters.

It is advantageous to use low carbon steel having sufficiently larger resistance temperature coefficient than nickel to prepare the second heater 6. Then it is possible not only to limit the power supplied to the first heater 5 to greatly improve the heating characteristic of the glow plug but also decrease the cost of manufacturing.

In the glow plug comprising the first heater 5 acting as a heat source and the control means thereof and the second heater, the invention is characterized in that the ratio of the length of the first heater and the outer diameter of the sheath 1 is selected to be less than 1.5 and that the ratio of the resistances at normal temperature 20° C. between the first heater 5 and the second heater 6 is selected in a range of 2.5–7.0.

More particularly, the length of the first heater 5 is important to improve the rapid heating characteristic so that it is necessary to make the length to a minimum as far as possible so as to increase the power density. On the other hand, the length of the second heater 6 is important to realize an adequate saturation temperature distribution so that it is essential to make equal the power densities of the first and second heaters at the time of saturation. Based on these facts we have found that if the ratio of the length of the first heater 5 to the outer diameter of the sheath 1 were selected to be less than 1.5, the rapid heating property and adequate saturation temperature could be obtained even though other factors vary more or less.

The resistance values of respective heaters are important to determine the temperature rise level with reference to the rated voltage. When the ratio of these resistance values is set in a range of 2.5–7.0, an adequate coordination between the rapid heating and the temperature distribution at the time of saturation can be obtained, thus obtaining adequate characteristics. When the ratio is on the outside of the specific range described above all characteristics degrade, particularly the rapid heating characteristic and the saturated temperature distribution.

According to this invention, as shown in FIG. 2, between first and second heaters 5 and 6 is provided a relatively large gap having a size of about 1.5–12 times of the helical pitch of the first heater 5, and both heaters 5 and 6 are electrically interconnected in this gap. With this construction, the heat transmission from the first heater 5 to the second heater 6 can be delayed by the heat insulating power in the gap so as to delay the current control by the second heater 6. Consequently, the large power supplying time to the first heater 5 can be increased to rapidly heat the first heater 5 to red heat so as to enhance temperature rise and to maintain the temperature at an adequate saturation temperature.

Care should be taken so as to control the second heater 6 with a suitable interval not to overheat the first heater, to select suitable length for the gap between both heaters 5 and 6 and to suitably connect the both heaters in the gap.

To this end according to this embodiment, a guide rod 8 made of such heat resistance material as ceramic extends through the first and second heaters to hold them at predetermined positions. The guide rod 8 is secured between the front inside of the sheath 1 and the end of an electrode rod 4. The ceramic guide rod 8 extending through the first and second heaters 5 and 6 is suitable to maintain an optimum gap between the first and second heaters 5 and 6 even when they are made of fine wires or soft materials. The use of the ceramic guide rod 8 facilitates insertion of the heaters 5 and 6 into the sheath 1. Moreover, even when the heater 5 or 6 may come into direct contact with the sheath 1, there is no fear of melting the sheath 1. When both heaters 5 and 6 have sufficient rigidity can be interconnected with a gap therebetween it is not necessary to use the guide rod 8.

The size of the gap should be determined depending upon the outer diameter of the sheath 1, the thickness and length thereof, and wire diameters, outer diamters, lengths and resistance values of both heaters 5 and 6, and where the winding pitches of both heaters is P, a preferred value of the gap is 1.5P–12P.

Figure 3:
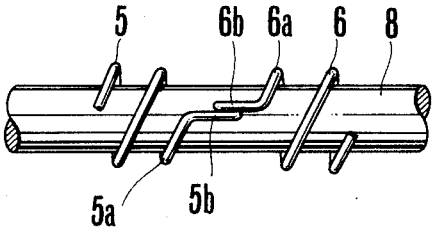
FIG. 3 is a fractional view showing a portion of FIG. 2.

Both heaters 5 and 6 are interconnected in the gap such that the heat transfer therebetween would be minimum. More particularly, in this embodiment, the innermost turns 5*a* and 6*a* of both heaters 5 and 6 are formed as straight portions 5*b* and 6*b* which are interconnected by plasma arc welding, for example. However, as shown in FIG. 3 the straight portions 5*b* and 6*b* may be overlapped and then welded together. The connecting portion is not necessary at the center of the gap as shown in FIGS. 2 and 3. Furthermore, the straight portions 5*b* and 6*b* may incline, curved or helical. In summary, it is only necessary to make small as far as possible for minimizing the heat transfer between first and second heaters 5 and 6 through the gap.

Figure 4:
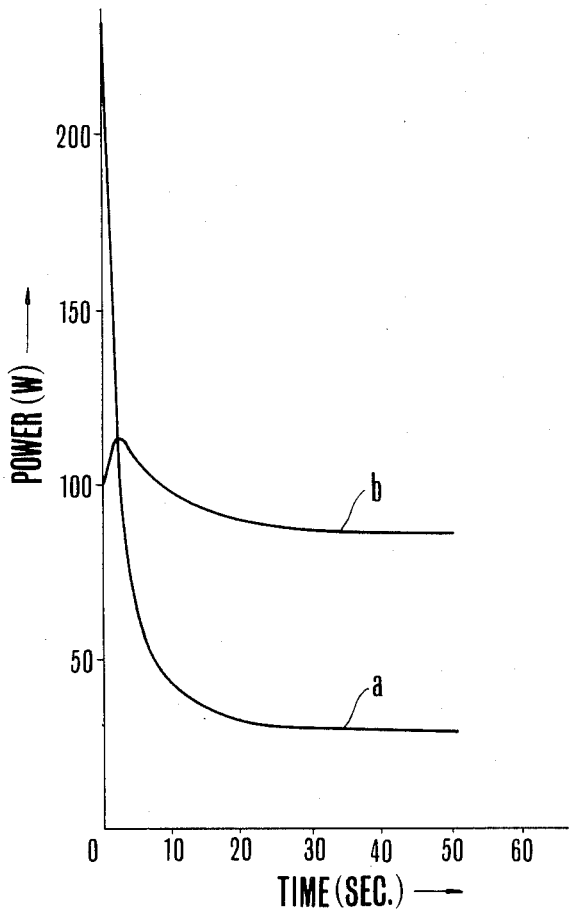
FIGS. 4 and 5 are graphs showing the characteristic curves useful to explain the operation of the glow plug of this invention.

With the glow plug having the construction described above, at a time immediately following passing current, as the resistance value of the second heater 6 is small, a large power concentrates to the first heater 5 and the power supplied amounts to 230 W as shown by characteristic a shown in FIG. 4 so that the first heater is heated quickly. The gap between the first and second heaters 5 and 6 delays transmission of heat from the first heater 5 to the second heater 6 which increases the interval in which a large power concentrates to the first heater 5, thus quickly heating the same.

As shown by characteristic b shown in FIG. 4, a power of about 100 W is applied to the second heater 6 whereby it gradually generates heat and its resistance value increases due to the heat generated by itself and the heat transmitted from the first heater 5. In response to the variation of the resistance value, current decreases and the voltage across the first heater also decreases whereby the power supplied to the first heater 5 decreases rapidly to prevent its overheating. At this time, the second heater 6 generates necessary heat by itself. Accordingly, the sheath 1 is gradually heated to a temperature (usually 900° C.) necessary to start the diesel engine.

Figure 5:
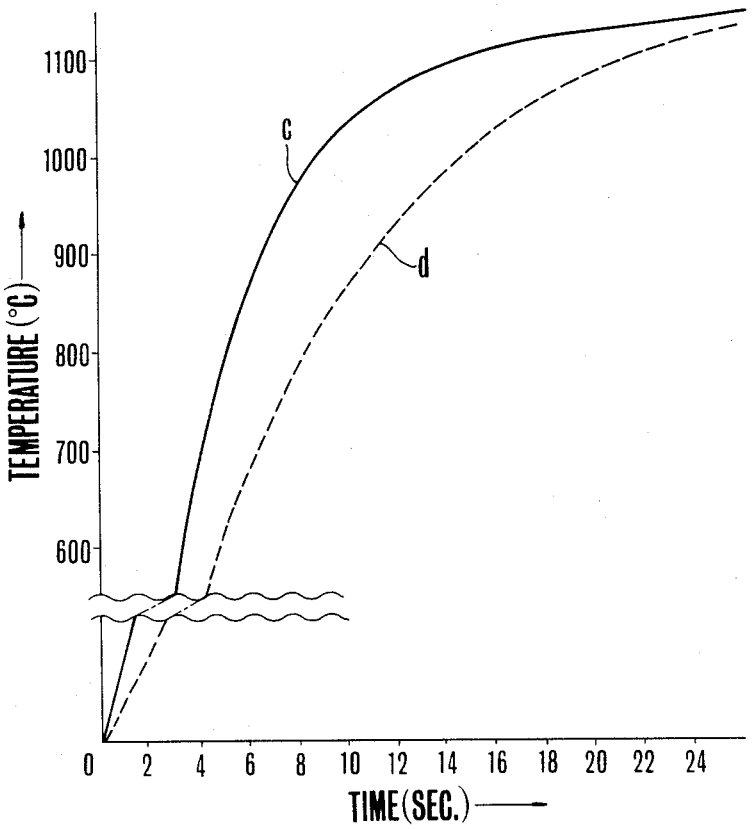

The heating characteristic of the glow plug embodying the invention is shown by curve c shown in FIG. 5 which shows a great improvement of the temperature build up characteristic over that d of the prior art.

The length of the gap between the first and second heaters 5 and 6 is made to be 1.5P–12P for the following reasons.

Figure 6:
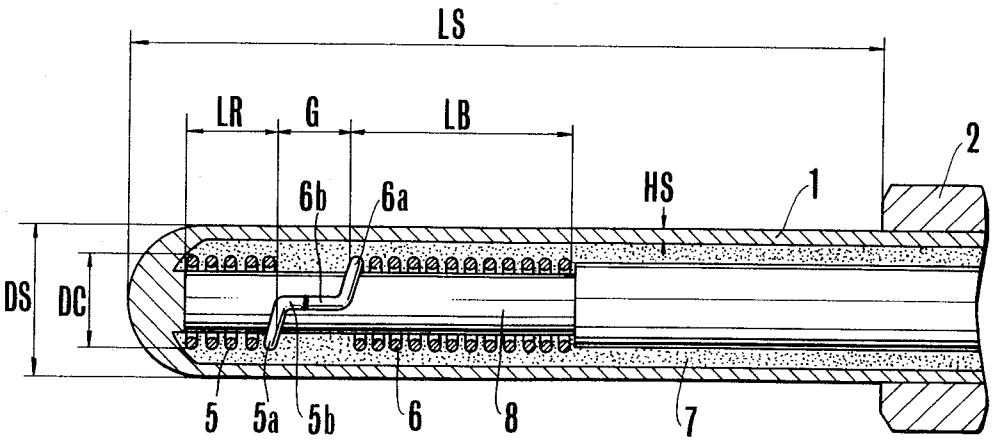
FIG. 6 is an enlarged longitudinal sectional view of the front portion of the glow plug useful to explain the experimental data.

As shown in FIG. 6, let us denote the outer diameter of the sheath 1 by DS, the wall thickness thereof by HS, the length of the sheath 1 protruding from the housing 2 by LS, the coil diameter of the first heater 5 by DC, the length thereof by LR, the length of the second heater 6 by LB and assume values of DS=5.0 mm, HS=0.8 mm, LS=25 mm, DC=2.3 mm, LR=3 mm, and LB=7 mm. Further, let us assume that the first heater 5 is made of a ferro-chromium wire having a diameter of 0.35 mm, a number of turns of 5, and a pitch of P=0.60 mm, and that the second heater 6 is made of a low carbon steel wire containing 0.01–0.10% by weight of carbon and having a diameter of 0.38 mm, a number of turns of 12 and a pitch P of 0.58 mm. The relation between heating time and the gap G is shown in FIG. 7 while that between the temperature and the gap G is shown by FIG. 8.

Figure 7:
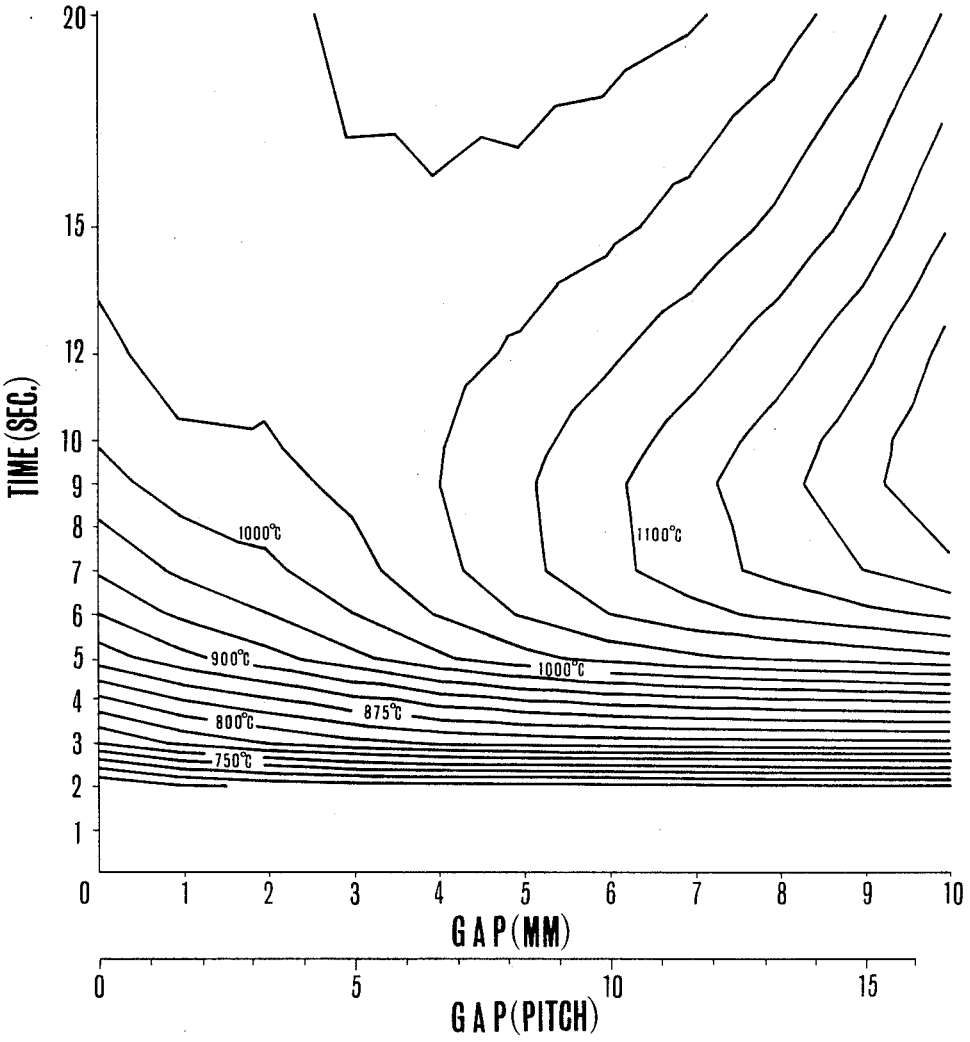
FIGS. 7 and 8 are graphs showing the relationship between the variation in a gap G and the temperature rise time and that between the variation in the gap G and the maximum temperature.
Figure 8:
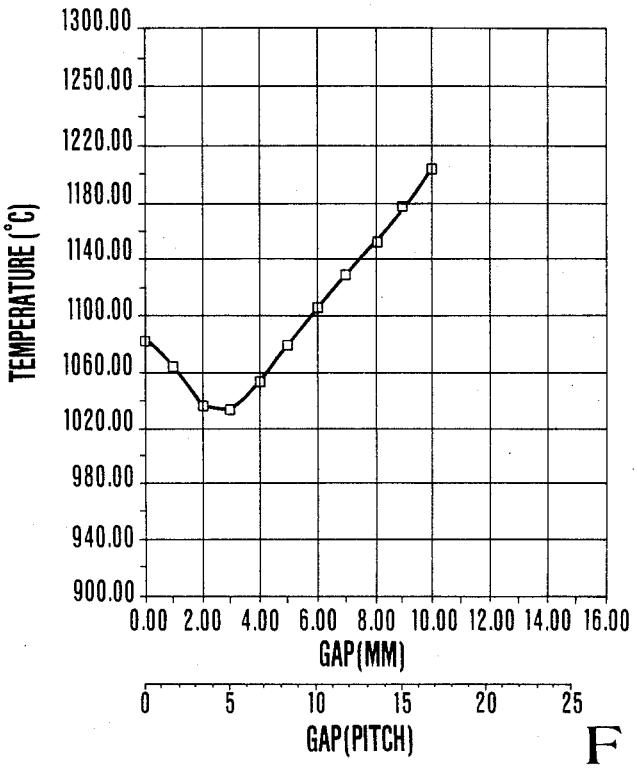

FIG. 7 shows a set of curves showing the relation between the gap (in mm and pitch between both heaters 5 and 6) and the temperature build up times (in sec) of the two heaters.

As can be noted from FIG. 7, in order to decrease the time necessary to reach the starting temperature (usually 900° C.) of the engine, the minimum length of the gap G between the two heaters 5 and 6 is 2 mm (larger than about 3.3 P). On the other hand, in order to prevent overheating of the first heater 5, its temperature should be less than 1150° C. FIG. 8 shows the relation between the gap between the two heaters 5 and 6 and the maximum temperature in °C. As can be noted from FIG. 8, in order to limit the temperature of the first heater, the gap G should be less than 7 mm (less than about 12P). Of course, these values are upper limits so that in the actual design these values are selected to be smaller than these values by taking into consideration the durability or life.

From the foregoing description it will be readily understood that, where above parameters are selected, the optimum value of the gap G amounts to 2–4 mm (3P–7P). Due to the modification of the design specification of the glow plug, even when the dimensions, pitches, etc. are changed, the result of experiments showed that so long as the length of the gap lies in a range of from 1 to 7 mm (1.5 P to 12 P), satisfactory operation can be assured.

Figure 9:
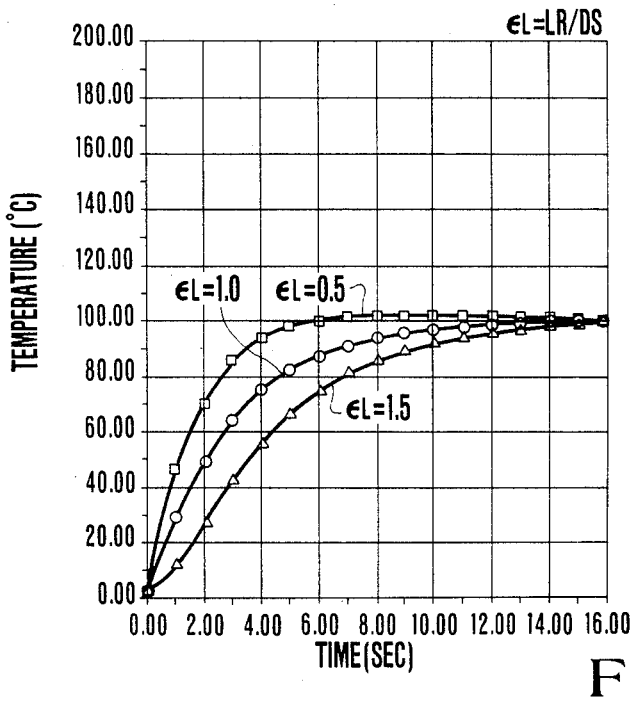
FIG. 9 is a graph showing the relationship between the temperature and build up time when the ratio of the sheath diameter to resistance of the first heating member is varied.

FIG. 9 shows the relation between the temperature generated and the time in sec. of the glow plug designed according to the conditions described above and wherein the coil length LR of the first heater 5 is varied, and the ratio $\epsilon_L$ between the outer diameter DS of sheath 1 and the length LR of the first heater 5 is varied. These curves shown in FIG. 9 show cases wherein LR=2.5 mm, 5.0 mm and 7.5 mm respectively. As can be noted from FIG. 9 the smaller is $\epsilon_L$, more excellent is the characteristic. Considering various conditions, with less than 1.5 of $\epsilon_L$, rapid heating property and an optimum saturation characteristic can be obtained.

The coil length LB of the second heater is also important to obtain desired characteristics described above and the result of experiments showed that the coil length LB of the second heater 6 should lie in a range of from 3–15 mm when the coil length LR of the first heater 5 varies in a range of from 1.5–7 mm.

Figure 10:
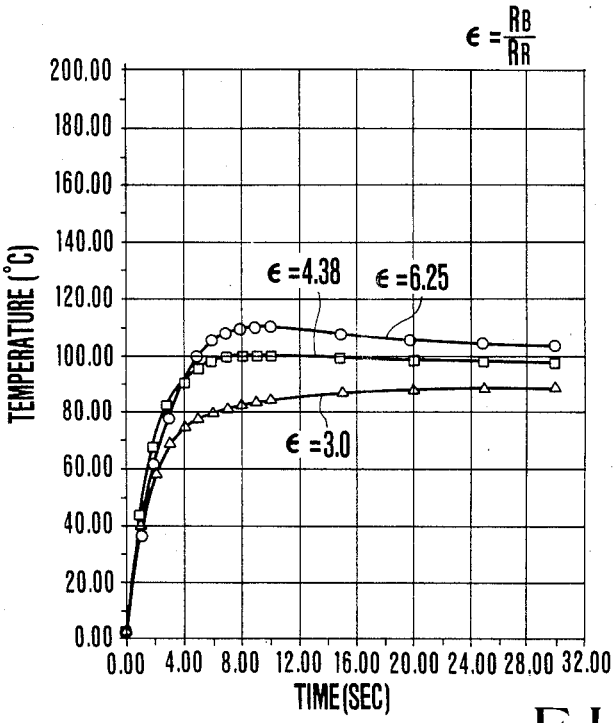
FIG. 10 is a graph showing the relation between the temperature and build up time when the resistance ratio of both heating members is changed.

FIG. 10 shows the relationship between the temperature generated and the build up time of the glow plug satisfying the conditions described above where the ratio $\epsilon$ between the resistance value $R_R$ at normal temperature of the first heater 5 and the resistance value $R_B$ at normal temperature of the second heater 6 is varied. FIG. 10 shows that the optimum characteristic can be obtained with $\epsilon=4.38$ ($R_R=0.35$ ohm, $R_B=0.08$ ohm).

More particularly, where $\epsilon=6.25$, the saturation temperature is too high, whereas when $\epsilon=3.0$, the rapid heating property degrades and the saturation temperature becomes too low.

An optimum characteristic can be obtained so long as $\epsilon$ is equal to 3.5–5.5 even when the conditions described above change more or less, and it is confirmed through experiments that a maximum range of 2.5–7.0 suffices, changes of various other conditions taken into account.

The material of the second heater 6 has a great influence upon the rapid heating property and the saturation temperature of the first heater 5 will be considered as follows. Thus it is necessary to form the second heater 6 with electroconductive material having sufficiently larger resistance temperature coefficient than that of the first resistor 5 so as to adequately control the power supplied to the first heater 5. As has been pointed out hereinabove the second heater 6 can be made of nickel, low carbon steel, etc.

Figure 11:
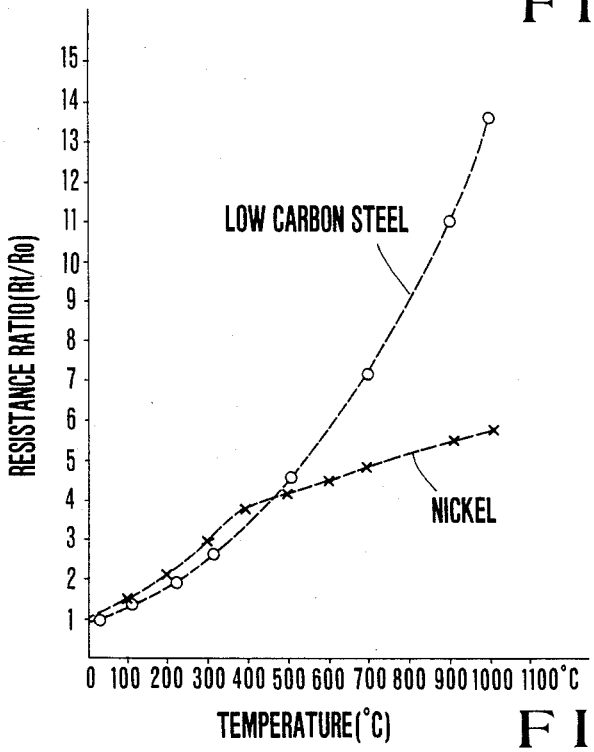
FIG. 11 shows characteristics of an optimum material for the second heating member.

As shown in FIG. 11, the relations between the temperature and the resistance ratio $R_t/R_o$ of nickel and low carbon steel differ greatly, wherein $R_t$ represents the resistance at t° C. and $R_o$ the resistance at 0° C. or at temperatures up to 20° C. Considering the heat generating characteristics, low carbon steel having higher resistance ratio at high temperatures than other materials is considered most suitable. The low carbon steel is not expensive contributing to lower the cost of the glow plug.

Figure 12:
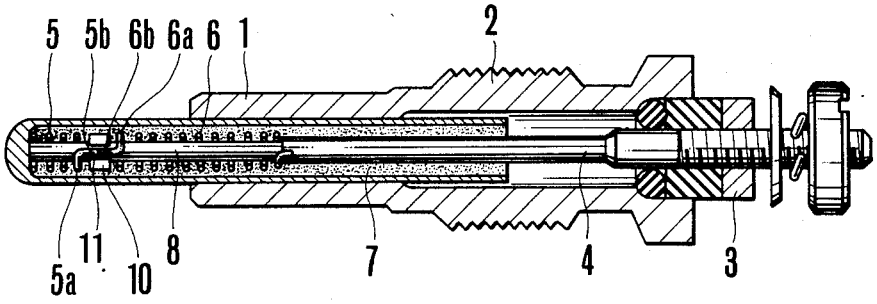
FIG. 12 is a longitudinal sectional view showing a modified embodiment of this invention.
Figure 13:
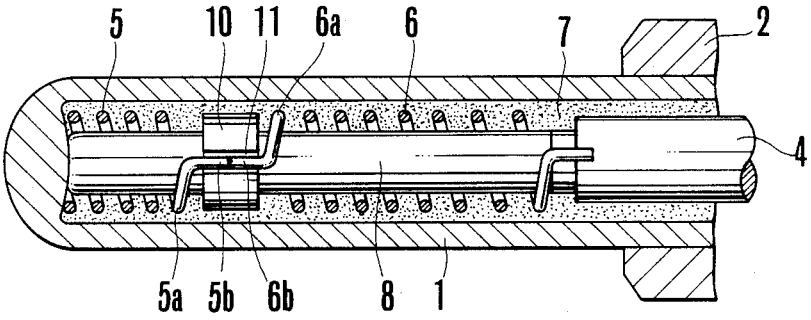
FIG. 13 is an enlarged view of the front portion of the modified embodiment shown in FIG. 9.
Figure 14:
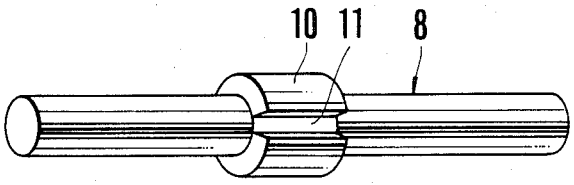
FIG. 14 is a perspective view showing a guide rod utilized in the modified embodiment shown in FIG. 9.

FIGS. 12 through 14 show another embodiment of this invention in which elements identical or corresponding to those shown in FIGS. 1 and 2 are designated by the same reference numerals.

According to this embodiment, a portion of the guide rod 8 positioned in the gap formed between the first and second heaters 5 and 6 is enlarged as at a portion 10 for preventing heat transmission between the first and second heaters 5 and 6, and the enlarged portion 10 is provided with a straight axial groove 11 for receiving a straight connector formed by the axial extensions **5*b* and 6*b* of the first and second heaters 5 and 6. As above described, the groove 11** and the connector are not necessary to be axial.

When the enlarged portion 10 is provided for the guide rod 8, it is possible to limit the heat transmitted between the two heaters 5 and 6 to a minimum necessary value so as to delay the current control effected by the second heater 6 which prolongs the time in which large power is concentrated to the first heater 5, thus accelerating its red heat. This also enables to accurately and stably adjust the time thereby greatly improving the heating characteristic. Moreover, since both heaters are electrically interconnected by the connector received in the groove 11 provided for the enlarged portion 10, the assembly of the glow plug can be facilitated. In addition, the enlarged portion 10 is effective to maintain a suitable gap between the two heaters.

It should be understood that the invention is not limited to the constructions described above and that many changes and modifications can be made. For example, it is not indispensable to space the two heaters 5 and 6 apart, and by setting the length ratio and resistance ratio of the two heaters to suitable values, required heat generating characteristics can be provided.

As above described according to the glow plug of this invention for use in a diesel engine comprising first and second heaters made of two materials having different resistance temperature coefficients, since the ratio of the length of the first heater to the sheath diameter is made to be less than 1.5 and since the resistance ratio between both heaters is selected to line in a range of 2.5 to 7.0, the following advantageous effects result. (1) During the initial stage of current passage, the second heater causes the large power to efficiently concentrate to the first heater to enhance rapid red heat so that the temperature rise characteristic can be improved greatly over the prior art thus obtaining a rapid heat type glow plug whereby the starting characteristic of a diesel engine can be improved greatly. (2) At the time of starting the engine due to the temperature control performance of the second heater, proper selection of the length ratio and resistance ratio of the two heaters, prevents the superheating the glow plug, thus providing an optimum saturation temperature, which prevents melting failure inherent to the prior art glow plug. Especially such control performance can be obtained where the second heater is made of low carbon steel. (3) By providing a gap having a length of about 1.5–12 times of the coil pitch of the first heater between both heaters, and by selecting suitable length ratio and resistance ratio of both heaters, the heat influence upon the second heater from the first heater can be delayed thereby improving the heat generating characteristic of the glow plug, the reliability of the operation and reducing the manufacturing cost. (4) By using an insulating guide rod with an enlarged diameter portion, not only more stable and adequate heat generating characteristic can be obtained but also welding of heating wires can be made readily.

What is claimed is:

1. A glow plug comprising a tubular casing having open ends provided wibh an external thread, an elongate tubular sleeve closed at one end and open at the other disposed in the tubular casing with the closed end protruding from one open end thereof and the open end within the tubular casing, an electrode rod disposed within the other open end of the casing and secured therein, said electrode rod extending axially into the tubular sleeve into abutting engagement with the closed end thereof and welded to said closed end of the tubular sleeve, said electrode rod being of two diameters and defining at the junction of the two diameters an annular shoulder located approximately mid-length of the tubular sleeve, a first electrically-conductive heating element in the form of a coil of predetermined positive resistance temperature coefficient disposed in the tubular sleeve about the electrode rod in concentric relation to the electrode rod and the tubular sleeve comprised of a helical coil of wire of open pitch and uniform diameter less than the inside diameter of the tubular sleeve, one end of which abuts the closed end of the tubular sleeve and is welded thereto, said coil being of a predetermined axial length, a second electrically-conductive heating element of predetermined positive resistance temperature coefficient higher than the first heating element disposed in the tubular sleeve about the electrode rod in concentric relation thereto and the tubular sleeve and axially spaced from the first heating element such that there is a gap between the adjacent ends of the heating elements, said heating elements collectively being of lesser axial length than the distance between the closed end of the tubular sleeve and the shoulder and said second heating element comprising a helical coil of wire of open pitch and uniform diameter corresponding in pitch and diameter to the first heating element and of an axial length greater than the axial length of the first coil with its distal end engaged with the shoulder and secured thereto and means connecting the coils at their adjacent ends comprising straight lengths of wire extending from the adjacent ends parallel to the longitudinal axis of the coils bridging the gap between the adjacent ends and welded to each other, an electrically-insulated, thermally-conductive particulate material filling the sleeve about the electrode rod and the spaces between the helices of the heating coils throughout the length of the tubular sleeve, characterized in that the gap between adjacent ends of the heating elements is of a length of 1.5 to 12 times the pitch of the helices of the coil of the first heating element, the ratio of the length of the first heating element to the diameter of the sleeve is less than 1.5, the resistance ratio at normal temperature of the first and second heating elements is 2.5 to 7.0 and the second heating element is comprised of nickel or low carbon steel.

* * * * *

UNITED STATES PATENT AND TRADEMARK OFFICE

CERTIFICATE OF CORRECTION

PATENT NO. : 4,549,071

DATED : Oct. 22, 1985

INVENTOR(S) : Hatanaka et al.

It is certified that error appears in the above-identified patent and that said Letters Patent is hereby corrected as shown below:

Col. 1, l. 36: delete "of" and insert --of-- after "tens"

Col. 4, l. 3: change "a" to --an--

Col. 4, l. 5: change "an" to --a--

Col. 5, l.48: insert--and--before "can"

Col. 6, l. 8: change "a shown" to --a shown--

Col. 6, l. 14: change "b shown" to --b shown--

Col. 6, l. 28: change "c shown" to --c shown--

Col. 6, l. 30: change "d of" to --d of--

Col. 9, l. 2: change "wibh" to --with--

Signed and Sealed this

*Twelfth* Day of *August 1986*

[SEAL]

*Attest:*

*Attesting Officer*

DONALD J. QUIGG

*Commissioner of Patents and Trademarks*